US008186359B2

(12) United States Patent
Ademe et al.

(10) Patent No.: US 8,186,359 B2
(45) Date of Patent: May 29, 2012

(54) SYSTEM FOR ANALYZING A FILTER ELEMENT ASSOCIATED WITH A SMOKING ARTICLE, AND ASSOCIATED METHOD

(75) Inventors: Balager Ademe, Winston-Salem, NC (US); Vernon Brent Barnes, Advance, NC (US); Travis Eugene Howard, Clemmons, NC (US); Robert William Benford, Kernersville, NC (US); Franklin Forrest Brantley, Winston-Salem, NC (US); Brent Walker Carter, High Point, NC (US); William Robert Collett, Lexington, NC (US); Darrell Thomas Dixon, Clemmons, NC (US); Larry Dean McCann, King, NC (US); John Larkin Nelson, Lewisville, NC (US); Gregory J. Roberts, Winston-Salem, NC (US); Timothy Frederick Thomas, High Point, NC (US); Calvin Wayne Henderson, Clemmons, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 996 days.

(21) Appl. No.: 12/024,687

(22) Filed: Feb. 1, 2008

(65) Prior Publication Data

US 2009/0194118 A1 Aug. 6, 2009

(51) Int. Cl.
*A24C 5/32* (2006.01)

(52) U.S. Cl. ..... 131/280; 131/905; 131/907; 209/536; 209/535; 356/237.2

(58) Field of Classification Search ..... 131/908, 131/907, 910, 905, 280; 209/535, 536; 356/237.2
See application file for complete search history.

(56) References Cited

U.S. PATENT DOCUMENTS 3,288,147 A 11/1966 Molins et al.

(Continued)

FOREIGN PATENT DOCUMENTS

EP 0 513 603 B1 11/1992

(Continued)

OTHER PUBLICATIONS

Borschke, A. J., "Review of Technologies Relating to Menthol Use in Cigarettes", *Rec. Adv. Tob. Sci.*, 1993, pp. 47-70, No. 19.

(Continued)

*Primary Examiner* — Richard Crispino
*Assistant Examiner* — Dionne Walls Mayes
(74) *Attorney, Agent, or Firm* — Womble Carlyle Sandridge & Rice, LLP

(57) ABSTRACT

A system and associated method for analyzing a filter element of at least one of a filter rod and a smoking article is provided. At least one sensor element is adapted to interact with the filter element so as to determine an object insertion status with respect thereto and to generate an output signal in response. The object insertion status includes at least one of an object presence within the filter element, an object absence from the filter element, a proper insertion of an object into the filter element, a defective insertion of an object into the filter element, a proper object within the filter element, and a defective object within the filter element. An analysis unit is in communication with the at least one sensor element and responsive to the output signal therefrom to generate an indicia corresponding to the object insertion status.

15 Claims, 4 Drawing Sheets

U.S. PATENT DOCUMENTS 3,297,038 A 1/1967 Homburger
3,308,600 A 3/1967 Erdmann et al.
3,339,557 A 9/1967 Karalus
3,339,558 A 9/1967 Waterbury
3,366,121 A 1/1968 Carty
3,390,686 A 7/1968 Irby, Jr. et al.
3,420,242 A 1/1969 Boukair
3,424,172 A 1/1969 Neurath et al.
3,428,049 A 2/1969 Leake et al.
3,508,558 A 4/1970 Seyburn
3,513,859 A 5/1970 Carty
3,547,130 A 12/1970 Harlow et al.
3,575,180 A 4/1971 Carty
3,596,665 A 8/1971 Lindgard
3,602,231 A 8/1971 Dock
3,625,228 A 12/1971 Dock
3,635,226 A 1/1972 Horsewell et al.
3,669,128 A 6/1972 Cohen
3,685,521 A 8/1972 Dock
3,797,644 A 3/1974 Shaw
3,818,223 A * 6/1974 Gibson et al. ..... 250/223 R
3,915,176 A 10/1975 Heitmann et al.
3,916,914 A 11/1975 Brooks et al.
3,972,335 A 8/1976 Tiggelbeck et al.
3,991,773 A 11/1976 Walker
4,003,387 A 1/1977 Goldstein
4,033,387 A 7/1977 Nijs et al.
4,046,153 A 9/1977 Kaye
4,082,098 A 4/1978 Owens, Jr.
4,126,141 A 11/1978 Grossman
4,238,993 A * 12/1980 Brand et al. ..... 131/280
4,280,187 A 7/1981 Reuland et al.
4,281,670 A 8/1981 Heitmann et al.
4,281,671 A 8/1981 Bynre et al.
4,284,088 A * 8/1981 Brand et al. ..... 131/280
4,291,713 A 9/1981 Frank
4,474,190 A 10/1984 Brand
4,574,816 A 3/1986 Rudszinat
4,677,995 A 7/1987 Kallianos et al.
4,729,391 A 3/1988 Woods et al.
4,736,754 A 4/1988 Heitmann et al.
4,781,203 A 11/1988 La Hue
4,807,809 A 2/1989 Pryor et al.
4,811,745 A 3/1989 Cohen et al.
4,844,100 A 7/1989 Holznagel
4,848,375 A 7/1989 Patron et al.
4,850,301 A 7/1989 Greene, Jr. et al.
4,862,905 A 9/1989 Green, Jr. et al.
4,865,056 A 9/1989 Tamaoki et al.
4,878,506 A 11/1989 Pinck et al.
4,889,144 A 12/1989 Tateno et al.
4,925,602 A 5/1990 Hill et al.
4,941,486 A 7/1990 Dube et al.
5,012,823 A 5/1991 Keritsis et al.
5,012,829 A 5/1991 Thesing et al.
5,025,814 A 6/1991 Raker
5,060,664 A 10/1991 Siems et al.
5,060,665 A 10/1991 Heitmann
5,156,169 A 10/1992 Holmes et al.
5,191,906 A 3/1993 Myracle, Jr.
5,220,930 A 6/1993 Gentry
5,223,185 A 6/1993 Takei et al.
5,225,277 A 7/1993 Takegawa et al.
5,271,419 A 12/1993 Arzonico et al.
5,331,981 A 7/1994 Tamaoki et al.
5,387,093 A 2/1995 Takei
5,387,285 A 2/1995 Rivers
5,476,108 A * 12/1995 Dominguez et al. ..... 131/108
5,724,997 A 3/1998 Smith et al.
6,229,115 B1 5/2001 Voss et al.
6,360,751 B1 3/2002 Fagg et al.
6,384,359 B1 * 5/2002 Belcastro et al. ..... 209/536
6,385,333 B1 * 5/2002 Puckett et al. ..... 382/143
6,647,870 B2 11/2003 Kohno
6,779,530 B2 8/2004 Kraker
6,848,449 B2 2/2005 Kitao et al.
6,904,917 B2 6/2005 Kitao et al.
7,074,170 B2 7/2006 Lanier, Jr. et al.
7,115,085 B2 10/2006 Deal
2002/0020420 A1 2/2002 Xue et al.
2002/0166563 A1 11/2002 Jupe et al.
2003/0098033 A1 5/2003 Macadam et al.
2003/0136419 A1 7/2003 Muller
2003/0145866 A1 8/2003 Hartmann
2003/0178036 A1 * 9/2003 Demmer et al. ..... 131/280
2004/0129281 A1 7/2004 Hancock et al.
2004/0261807 A1 12/2004 Dube et al.
2005/0016556 A1 1/2005 Ashcraft et al.
2005/0039764 A1 2/2005 Barnes et al.
2005/0054501 A1 3/2005 Schroder
2005/0066986 A1 3/2005 Nestor et al.
2005/0070409 A1 3/2005 Deal
2005/0076929 A1 4/2005 Fitzgerald et al.
2005/0103355 A1 5/2005 Holmes
2005/0133051 A1 6/2005 Luan et al.
2005/0194014 A1 9/2005 Read, Jr.
2006/0112964 A1 6/2006 Jupe et al.
2006/0144412 A1 7/2006 Mishra et al.
2006/0174901 A1 8/2006 Karles et al.
2006/0207616 A1 * 9/2006 Hapke et al. ..... 131/280
2006/0272655 A1 12/2006 Thomas et al.
2006/0272663 A1 12/2006 Dube et al.
2006/0293157 A1 12/2006 Deal
2007/0012327 A1 1/2007 Karles et al.
2007/0068540 A1 3/2007 Thomas et al.
2007/0095357 A1 5/2007 Besso et al.
2007/0117700 A1 5/2007 Kushihashi et al.
2007/0246055 A1 10/2007 Oglesby
2008/0029118 A1 2/2008 Nelson et al.
2009/0090372 A1 4/2009 Thomas et al.
2009/0120449 A1 * 5/2009 Tindall ..... 131/334
2010/0099543 A1 4/2010 Deal

FOREIGN PATENT DOCUMENTS

EP 1 702 524 9/2006
EP 1 767 107 3/2007
WO WO 03/009711 A1 2/2003
WO WO 03/055338 7/2003
WO WO 2004/047572 A1 6/2004
WO WO 2004/057986 A2 7/2004
WO WO 2006/064371 A1 6/2006
WO WO 2006/136196 A1 12/2006
WO WO 2006/136197 A1 12/2006
WO WO 2006/136198 A1 12/2006
WO WO 2006/136199 A1 12/2006
WO WO 2007/010407 A3 1/2007
WO WO 2007/012981 A2 2/2007
WO WO 2007/012981 A3 2/2007
WO WO 2007/038053 4/2007
WO WO 2007/060543 A2 5/2007
WO WO 2008/012329 A2 1/2008

OTHER PUBLICATIONS

Fagg, "Filtered Cigarette", U.S. Appl. No. 11/537,812, filed Oct. 2, 2006.

Strokes et al., "Apparatus for Inserting Objects into a Filter Component of a Smoking Article, and Associated Method", U.S. Appl. No. 11/760,983, filed Jun. 11, 2007.

* cited by examiner

SYSTEM FOR ANALYZING A FILTER ELEMENT ASSOCIATED WITH A SMOKING ARTICLE, AND ASSOCIATED METHOD

BACKGROUND OF THE INVENTION

1. Field of the Invention

Embodiments of the present invention relate to the manufacture of filter rods and smoking articles incorporating such filter rods and, more particularly, to systems and methods for analyzing a filter element associated with a smoking article, such as a cigarette, for determining an object insertion status with respect thereto.

2. Description of Related Art

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R. J. Reynolds Tobacco Company (1972). For example, one type of tobacco flavoring additive is menthol. See, Borschke, *Rec. Adv. Tob. Sci.,* 19, p. 47-70, 1993. Various proposed methods for modifying the sensory attributes of cigarettes have involved suggestion that filter elements may be used as vehicles for adding flavor to the mainstream smoke of those cigarettes. U.S. Pat. Appl. Pub. No. 2002/0166563 to Jupe et al. proposes the placement of adsorbent and flavor-releasing materials in a cigarette filter. U.S. Pat. Appl. Pub. No. 2002/0020420 to Xue et al. proposes the placement of fibers containing small particle size adsorbents/absorbents in the filter. U.S. Pat. Nos. 4,941,486 to Dube et al. and 4,862,905 to Green, Jr. et al. propose the placement of a flavor-containing pellet in a cigarette filter. Other representative types of cigarette filters incorporating flavoring agents are set forth in U.S. Pat. Nos. 3,972,335 to Tiggelbeck et al.; 4,082,098 to Owens, Jr.; 4,281,671 to Byrne; 4,729,391 to Woods et al.; and 5,012,829 to Thesing et al.

Cigarettes having adjustable filter elements that allow smokers to select the level of flavor that is available for transfer into mainstream smoke have been proposed. See, for example, U.S. Pat. Nos. 4,677,995 to Kallianos et al. and 4,848,375 to Patron et al. Some proposed cigarettes may be manipulated, reportedly for the purpose of providing components of their filter elements with the propensity to modify the nature or character of mainstream smoke. See, for example, U.S. Pat. Nos. 3,297,038 to Homburger; 3,339,557 to Karalus; 3,420,242 to Boukar; 3,508,558 to Seybum; 3,513,859 to Carty; 3,596,665 to Kindgard; 3,669,128 to Cohen; and 4,126,141 to Grossman.

Some proposed cigarettes have a hollow object positioned in their filter element, and the contents of that object is reportedly released into the filter element upon rupture of the object in the attempt to alter the nature or character of the mainstream smoke passing through the filter element. See, for example, U.S. Pat. Nos. 3,339,558 to Waterbury; 3,366,121 to Carty; 3,390,686 to Irby, Jr. et al.; 3,428,049 to Leake; 3,547,130 to Harlow et al; 3,575,180 to Carty; 3,602,231 to Dock; 3,625,228 to Dock; 3,635,226 to Horsewell et al.; 3,685,521 to Dock; 3,916,914 to Brooks et al.; 3,991,773 to Walker; and 4,889,144 to Tateno et al.; US Pat. Application Pub. Nos. 2004/0261807 to Dube et al; and 2005/0070409 to Deal; US Pat. Application Pub. Nos. 2007/0095357 to Besso et al.; 20070012327 to Karles et al.; 2006/0174901 to Karles et al.; 2006/0144412 to Mishra et al.; 2006/0112964 to Jupe et al.; and PCT WO 03/009711 to Kim and WO 2007/060543 to Besso et al. Some proposed cigarettes may also have a capsule positioned in the filter element, and the contents of that capsule reportedly released into the filter element upon rupture of the capsule in order to deodorize the filter element after the cigarette is extinguished. See, for example, US Pat. Appl. Pub. No. 2003/0098033 to MacAdam et al.

Commercially marketed "Rivage" brand cigarettes have included a filter possessing a cylindrical plastic container containing water or a liquid flavor solution. Cigarettes representative of the "Rivage" brand cigarettes are described in U.S. Pat. Nos. 4,865,056 to Tamaoki et al. and 5,331,981 to Tamaoki et al., both of which are assigned to Japan Tobacco, Inc. The cylindrical casing within the filter reportedly may be deformed upon the application of external force, and a thin wall portion of the casing is consequently broken so as to permit release of the liquid within the casing into an adjacent portion of that filter.

A cigarette holder has been available under the brand name "Aquafilter." Cigarette holders representative of the "Aquafilter" brand product are described in U.S. Pat. Nos. 3,797,644 to Shaw; 4,003,387 to Goldstein; and 4,046,153 to Kaye; assigned to Aquafilter Corporation. Those patents propose a disposable cigarette holder into which the mouth end of a cigarette is inserted. Smoke from the cigarette that is drawn through the holder reportedly passes through filter material impregnated with water. A disposable filter adapted to be attachable to the mouth end of a cigarette has been proposed in U.S. Pat. No. 5,724,997 to Smith et al. A flavor-containing capsule contained within the disposable filter reportedly may be squeezed in order to release the flavor within the capsule.

In some instances, smokers might desire a cigarette that is capable of providing, selectively, a variety of different flavors, depending upon the smoker's immediate desire. The flavor of such a cigarette can be selected based on the smoker's desire for a particular flavor at that time, or a desire to change flavors during the smoking experience. For example, changing flavors during the smoking experience enables a smoker to end the cigarette with a breath freshening flavor, such as menthol or spearmint. Some smokers also desire a cigarette that is capable of releasing a deodorizing agent upon completion of a smoking experience. Such agents are used to ensure that the remaining portion of a smoked cigarette yields a pleasant aroma after the smoker has finished smoking that cigarette. Some smokers desire a cigarette that is capable of moistening, cooling, or otherwise modifying the nature or character of the mainstream smoke generated by that cigarette. Because certain agents that can be used to interact with smoke are volatile and have the propensity to evaporate over time, the effects of those agents upon the behavior of those cigarettes may require introduction of those agents near commencement of the smoking experience. Such means for providing a smoker with the ability to enhance a sensory aspect of his/her smoking experience, and the extent or magnitude of that sensory experience, can be accomplished by allowing the smoker to purposefully select a cigarette incorporating smoke-altering solid objects such as flavor pellets, flavor capsules, flavored or non-flavored strands, exchange resin beads, adsorbent/absorbent particles, or possibly various combinations thereof, into cigarette filters, in a rapid, highly automated fashion.

To that end, apparatuses and processes have been developed for providing filter rods for use in the manufacture of smoking articles, wherein each rod has one or more objects (e.g., rupturable capsules, pellets, strands, or combinations thereof) disposed along its length such that, when the rod is subdivided into rod portions, each rod portion includes at least one of such objects. See, for example, U.S. Pat. No. 7,115,085 to Deal, which is incorporated herein by reference in its entirety. Such apparatuses can incorporate equipment for supplying a continuous supply of filter material (e.g., a filter tow processing unit adapted to supply filter tow to a continuous rod forming unit). A representative apparatus may also include, for example, a hopper and rotating wheel arrangement such as disclosed in U.S. Patent Application Publication No. US 2007/0068540 A1 to Thomas et al. (and incorporated herein by reference), for supplying the objects to the filter material. In still other instances, multiple objects (i.e., capsules, pellets) and/or strands; or at least one of a capsule, pellet, or strand in combination with at least one other of the capsule, pellet, or strand; can be inserted into the filter material by an object-insertion unit. Arrangements for inserting strands/objects into the filter material are disclosed, for example, in U.S. patent application Ser. No. 11/461,941 to Nelson et al. and U.S. patent application Ser. No. 11/760,983 to Stokes et al., which are incorporated herein by reference.

Typically, during the manufacturing process, the filter material is formed into a continuous rod having the objects positioned within that rod and along the longitudinal axis thereof. The continuous rod then is subdivided at predetermined intervals so as to form a plurality of filter rods or rod portions such that each rod portion includes at least one of the objects therein. In instances of the objects comprising, for example, a capsule and/or a pellet, and also including a strand, the capsules and/or pellets may be disposed at predetermined positions within and along the filter rod or filter element, while the strand, if any, extends through the filter rod or filter element.

However, such apparatuses and processes for inserting objects within the filter rod may produce some defective filter rods or portions thereof. That is, one or more of the objects inserted within a filter rod may be, for instance, missing, misoriented, or, in the case of rupturable elements, already ruptured. As such, it may be desirable to be able to detect such defective filter rods of portions thereof, such that any defective filter rod, or at least the defective portion(s) thereof, can be removed from the manufacturing process. In this manner, several benefits may be realized such as, for example, increasing the yield of the manufacturing process for such smoking articles, and preventing smoking articles having such defective filter rods from reaching consumers. An infrared inspection/detection system using visual detection sensors to detect and inspect objects having a contrasting shade or color with respect to the filter element, and for relaying information regarding such an object (or absence thereof) within the filter rod, is disclosed, for example, in U.S. Patent Application Publication No. US 2007/0068540 A1 to Thomas et al. and U.S. patent application Ser. No. 11/760,983 to Stokes et al., which are incorporated herein by reference. However, such inspection/detection systems may be limited as applied in such a manner due, for example, to the variety of objects that may be inserted into the filter element of a smoking articles and the resulting variety of possible defects that could occur. Further, the inserted object(s) may not have the contrasting shade or color with respect to the filter element, required for such inspection/detection systems to function as disclosed.

As such, there exists a need for an improved detection/inspection system and method applicable to the variety of objects, and combinations of such objects, that can be inserted into a filter element of a smoking article. Further, such an inspection/detection system should be capable of determining the variety of defects that may be possible with the aforementioned variety of objects. It would be further desirable to be able to detect/inspect such filter elements in either an "on-line" manner during the manufacturing or production process, or an "off-line" manner such as during an inspection or quality control process outside the manufacturing or production process, as appropriate. Such an inspection/detection system should also be capable of detecting/inspecting the objects with respect to the filter element, without requiring particular attributes of the objects such as a contrasting shade or color with respect to the filter element.

BRIEF SUMMARY OF THE INVENTION

The above and other needs are addresses by the present invention which, in particular aspects, relates to a system and process for detecting and inspecting one or more objects (e.g., rupturable capsules, pellets, strands, or combinations thereof) inserted into and disposed within a filter element or along the length of a filter rod, each associated with a smoking article.

Aspects of the present invention comprise systems and methods for analyzing a filter element of at least one of a filter rod and a smoking article. Such aspects include sensor means, such as at least one sensor element, adapted to interact with the filter element so as to determine an object insertion status with respect thereto, and to generate an output signal in response. The object insertion status includes at least one of an object presence within the filter element, an object absence from the filter element, a proper insertion of an object into the filter element, a defective insertion of an object into the filter element, a proper object within the filter element, and a defective object within the filter element. Analysis means, such as an analysis unit, is in communication with the sensor means/at least one sensor element and is responsive to the output signal therefrom to generate an indicia corresponding to the object insertion status.

Aspects of the present invention thus provide significant advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
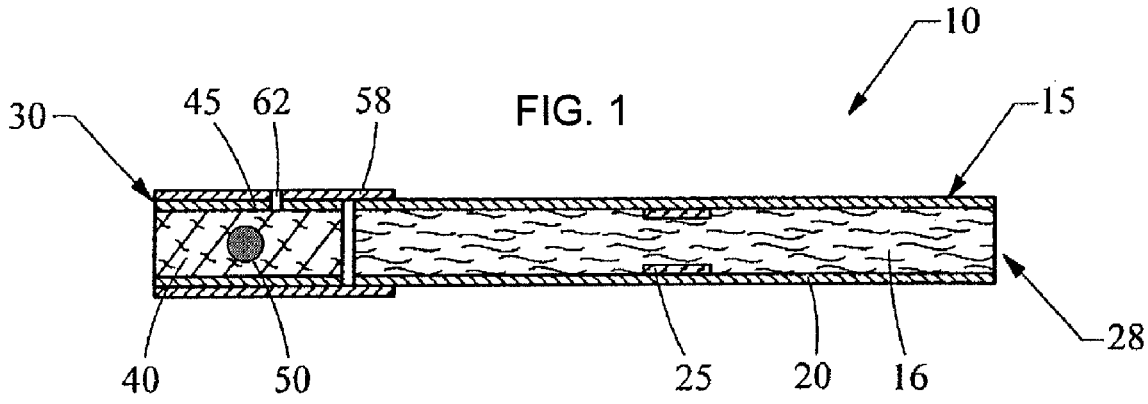
FIG. 1 is a cross-sectional view of a smoking article having the form of a cigarette, showing the smokable material, the wrapping material components, and the interconnected objects-containing filter element of that cigarette.

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Cigarette rods are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. Nos. 4,781,203 to La Hue; 4,844,100 to Holznagel; 5,156,169 to Holmes et al.; 5,191,906 to Myracle, Jr. et al.; 6,647,870 to Blau et al.; 6,848,449 to Kitao et al.; and 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. Nos. 3,288,147 to Molins et al.; 3,915,176 to Heitmann et al; 4,291,713 to Frank; 4,574,816 to Rudszinat; 4,736,754 to Heitmann et al. 4,878,506 to Pinck et al.; 5,060,665 to Heitmann; 5,012,823 to Keritsis et al. and 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Filtered cigarettes incorporating filter elements provided from filter rods can be manufactured using traditional types of cigarette making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. Nos. 3,308,600 to Erdmann et al.; 4,281,670 to Heitmann et al.; 4,280,187 to Reuland et al.; and 6,229,115 to Vos et al.; and U.S. Patent Application Publication Nos. 2005/0103355 to Holmes and 2005/0194014 to Read, Jr.; each of which is incorporated herein by reference. The operation of those types of devices will be readily apparent to those skilled in the art of automated cigarette manufacture.

Cigarette filter rods can be used to provide multi-segment filter rods. Such multi-segment filter rods can be employed for the production of filtered cigarettes possessing multi-segment filter elements. An example of a two-segment filter element is a filter element possessing a first cylindrical segment incorporating activated charcoal particles (e.g., a "dalmation" type of filter segment) at one end, and a second cylindrical segment that is produced from a filter rod, with or without objects inserted therein. The production of multi-segment filter rods can be carried out using the types of rod-forming units that have been employed to provide multi-segment cigarette filter components. Multi-segment cigarette filter rods can be manufactured, for example, using a cigarette filter rod making device available under the brand name Mulfi from Hauni-Werke Korber & Co. KG of Hamburg, Germany.

Various types of cigarette components, including tobacco types, tobacco blends, top dressing and casing materials, blend packing densities; types of paper wrapping materials for tobacco rods, types of tipping materials, and levels of air dilution, can be employed. See, for example, the various representative types of cigarette components, as well as the various cigarette designs, formats, configurations and characteristics, that are set forth in U.S. Pat. Nos. 5,220,930 to Gentry and 6,779,530 to Kraker; U.S. Patent Application Publication Nos. 2005/0016556 to Ashcraft et al.; 2005/0066986 to Nestor et al.; 2006/0272655 to Thomas et al.; and 2007/0246055 to Oglesby et al.; each of which is incorporated herein by reference.

Filter rods can be manufactured using a rod-making apparatus, and an exemplary rod-making apparatus includes a rod-forming unit. Representative rod-forming units are available as KDF-2, KDF-2E, KDF-3, and KDF-3E from Hauni-Werke Korber & Co. KG; and as Polaris-ITM Filter Maker from International Tobacco Machinery. Filter material, such as cellulose acetate filamentary tow, typically is processed using a conventional filter tow processing unit. For example, filter tow can be bloomed using bussel jet methodologies or threaded roll methodologies. An exemplary tow processing unit has been commercially available as E-60 supplied by Arjay Equipment Corp., Winston-Salem, N.C. Other exemplary tow processing units have been commercially available as AF-2, AF-3 and AF-4 from Hauni-Werke Korber & Co. KG. and as Candor-ITM Tow Processor from International Tobacco Machinery. Other types of commercially available tow processing equipment, as are known to those of ordinary skill in the art, can be employed. Other types of filter materials, such as gathered paper, nonwoven polypropylene web or gathered strands of shredded web, can be provided using the types of materials, equipment and techniques set forth in U.S. Pat. Nos. 4,807,809 to Pryor et al. and 5,025,814 to Raker. In addition, representative manners and methods for operating a filter material supply units and filter-making units are set forth in U.S. Pat. Nos. 4,281,671 to Bynre; 4,850,301 to Green, Jr. et al.; 4,862,905 to Green, Jr. et al.; 5,060,664 to Siems et al.; 5,387,285 to Rivers and 7,074,170 to Lanier, Jr. et al.

Representative types of filter rods incorporating objects, and representative types of cigarettes possessing filter elements incorporating objects, such as flavor-containing capsules or pellets, can possess the types of components, format and configuration, and can be manufactured using the types of techniques and equipment set forth in U.S. Patent Application Publication No. 2007/0068540 A1 to Thomas et al.; U.S. Pat. No. 7,115,085 to Deal; 4,862,905 to Green, Jr. et al.; U.S. patent application Ser. No. 11/461,941 to Nelson et al.; and U.S. patent application Ser. No. 11/760,983 to Stokes et al.; which are incorporated herein by reference in their entireties.

Referring to FIG. 1, there is shown a smoking article 10, such as a cigarette, possessing certain representative components of a smoking article. The cigarette 10 includes a generally cylindrical rod 15 of a charge or roll of smokable filler material 16 contained in a circumscribing wrapping material 20. The rod 15 is conventionally referred to as a "tobacco rod." The ends of the tobacco rod are open to expose the smokable filler material. The cigarette 10 is shown as having one optional band 25 (e.g., a printed coating including a film-forming agent, such as starch, ethylcellulose, or sodium alginate) applied to the wrapping material 20, and that band circumscribes the cigarette rod in a direction transverse to the longitudinal axis of the cigarette. That is, the band provides a cross-directional region relative to the longitudinal axis of the cigarette. The band can be printed on the inner surface of the wrapping material (i.e., facing the smokable filler material) as shown, or less preferably, on the outer surface of the wrapping material. Although the cigarette can possess a wrapping material having one optional band, the cigarette also can possess wrapping material having further optional spaced bands numbering two, three, or more.

The wrapping material 20 of the tobacco rod 15 can have a wide range of compositions and properties. The selection of a particular wrapping material will be readily apparent to those skilled in the art of cigarette design and manufacture. Tobacco rods can have one layer of wrapping material; or tobacco rods can have more than one layer of circumscribing wrapping material, such as is the case for the so-called "double wrap" tobacco rods. Exemplary types of wrapping materials, wrapping material components and treated wrapping materials are described in U.S. Pat. No. 5,220,930 to Gentry; U.S. Pat. Application Pub. Nos. 2004/0129281 to Hancock et al. and 2005/0039764 to Barnes et al.; PCT Application Pub. No. WO 2004/057986 to Hancock et al.; and PCT Application Pub. No. WO 2004/047572 to Ashcraft et al., each of which is incorporated herein by reference in its entirety.

At one end of the tobacco rod 15 is the lighting end 28, and at the other end is positioned a filter element 30. The filter element 30 is positioned adjacent one end of the tobacco rod 15 such that the filter element and tobacco rod are axially aligned in an end-to-end relationship, preferably abutting one another. Filter element 30 may have a generally cylindrical shape, and the diameter thereof may be essentially equal to the diameter of the tobacco rod. The ends of the filter element permit the passage of air and smoke therethrough. The filter element 30 includes filter material 40 (e.g., cellulose acetate tow impregnated with triacetin plasticizer) that is overwrapped along the longitudinally extending surface thereof with circumscribing plug wrap material 45. That is, the filter element 30 is circumscribed along its outer circumference or longitudinal periphery by a layer of plug wrap 45, and each end is open to expose the filter material 40.

The filter element 30 is attached to the tobacco rod 15 using tipping material 58 (e.g., essentially air impermeable tipping paper), that circumscribes both the entire length of the filter element 30 and an adjacent region of the tobacco rod 15. The inner surface of the tipping material 58 is fixedly secured to the outer surface of the plug wrap 45 and the outer surface of the wrapping material 20 of the tobacco rod, using a suitable adhesive; and hence, the filter element and the tobacco rod are connected to one another.

Within the filter element 30 may be positioned at least one object 50, and in some instances a plurality of objects 50 (including, for example, capsules, pellets, strands), which can include various combinations of different objects. The number of objects within each filter element is typically a predetermined number, and that number can be 1, 2, 3, or more (i.e., at least one). In some instances, each filter element contains a plurality of objects disposed within the filter material 40 of the filter element wherein, in further instances, the objects may be particularly disposed toward the central region of the filter element. The nature of the filter material 40 is such that the objects 50 are secured or lodged in place within the filter element 30. In some instances, some of the at least one object 50 (or plurality of objects 50) are hollow, such as a breakable capsule, and carry a payload incorporating a compound that is intended to introduce some change to the nature or character of mainstream smoke drawn through that filter element (e.g., a flavoring agent). That is, the shell of some hollow objects 50 may be ruptured at the discretion of the smoker to release the object payload. Alternatively, some objects 50 may be a solid, porous material with a high surface area capable of altering the smoke and/or air drawn through the filter element. Some objects may be a solid material, such as a polyethylene bead, acting as a substrate or matrix support for a flavoring agent. Some objects are capable of releasing the agent at the command of the user. For example, a breakable hollow object containing a liquid payload is resistant to the release of the payload until the time that the smoker applies a purposeful application of physical force sufficient to rupture the hollow object. Typically, a filter material, such as cellulose acetate tow, or an inserted strand, is generally absorbent of liquid materials of the type that comprise the payload, and hence the released payload components are capable of undergoing wicking (or otherwise experiencing movement or transfer) throughout the filter element. Since at least one object may be included in each filter element, the filter element may include combinations of various types of objects, as appropriate or desired.

The objects can vary. Each object may possess a generally spherical shape, and, in some instances, may be highly spherical in nature. Some objects can be generally solid in nature. Some objects can be composed of a plastic material; and each can be, for example, a solid spherical bead composed of a mixture of polyethylene and flavor, or a spherical bead having the form of exchange resin or gel. Some objects can be composed of an inorganic material; and can be for example, a spherical alumina bead. The objects also can each have the form of a spherical bead composed of a carbonaceous material. The objects also can each have the form of a hollow sphere. Typical hollow objects are liquid-containing objects, such as breakable capsules, which are highly spherical, are uniform in size and weight, have surface properties that allow such objects to be processed efficiently and effectively using automated filter making equipment, and are highly uniform in composition. Some objects have diameters of about 3 mm to about 4 mm, preferably about 3.5 mm, and the components of the preferred filter rod-making equipment of the present invention are suitably adapted or designed to efficiently and effectively produce filter rods incorporating those types of objects.

Other types of objects, beads, pellets, capsules and capsule components that can be employed for the production of filter rods using the foregoing filter rod manufacturing techniques and equipment are of the type set forth in U.S. Pat. Nos. 3,685,521 to Dock; 3,916,914 to Brooks et al.; and 4,889,144 to Tateno et al.; US Pat. Appl. Pub. No. 2003/0098033 to MacAdam et al. and 2004/0261807 to Dube et al.; and PCT Application Pub. No. WO 03/009711 to Kim; which are incorporated herein by reference. Tobacco products can incorporate those types of components set forth in US Patent Publication Nos. 2006/0272663 to Dube et al., 2005/0133051 to Luan et al., 2006/0144412 to Mishra et al.; 2007/0012327 to Karles et al.; and 2007/0068540 to Thomas et al.; PCT WO 2006/136196; PCT WO 2006/136197; PCT WO 2006/136198; PCT WO 2006/136199; PCT WO 2007/012981; PCT WO 2007/010407; PCT WO 2007/060543; PCT WO 2008/012329; EP 0513603; U.S. Pat. Nos. 5,223,185 and 5,387,093; and U.S. Pat. No. 7,115,085 to Deal; as well as within filtered cigarettes that have been marketed under the tradename "Camel Lights with Menthol Boost" by R. J. Reynolds Tobacco Company. Exemplary pelletized carrier materials and flavor packages are of the type employed in cigarettes that have been marketed commercially in the USA. For example, flavor-carrying pellets have been incorporated into cigarette filters employed on Camel brand cigarettes under the tradenames Mandalay Lime, Mandarin Mint, Breach Breezer, Back Ally Blend, Snakeyes Scotch, Izmir Stinger, Kauai Kolada, Midnight Madness, Aegean Spice, Screwdriver Slots, Twist, Twista Lime, Dark Mint and Blackjack Gin; Kool brand cigarettes under the tradenames Flow and Groove; and Salem brand cigarettes under the tradename Deep Freeze; all of which have been marketed by R.J. Reynolds Tobacco Company (see, e.g., U.S. Pat. No. 4,826,905 to Green, Jr. et al.).

The objects may be attached or otherwise associated with a strand, and the size of a strand of objects can vary, with the diameter thereof being up to about 2.5 mm, or up to about 3 mm, and sometimes up to about 4 mm. However, due to, for example, limitations in the size (diameter) of the filter rod or filter element, larger diameter strands require smaller dimensions of other objects (i.e., capsules and/or pellets) such that the other objects can be inserted into the filter material with the strand, while providing the desired dimensions of the filter rod or filter element. In some instances, one or more individual strands are inserted into the filter material, in addition to at least one other object such as a capsule or a pellet. In instances of the other objects comprising, for example, a capsule and/or a pellet, and the filter rod also including a strand, the capsules and/or pellets are disposed at predetermined positions within and along the filter rod or filter element, while the strand, if any, extends through the filter rod or filter element.

Figure 2:
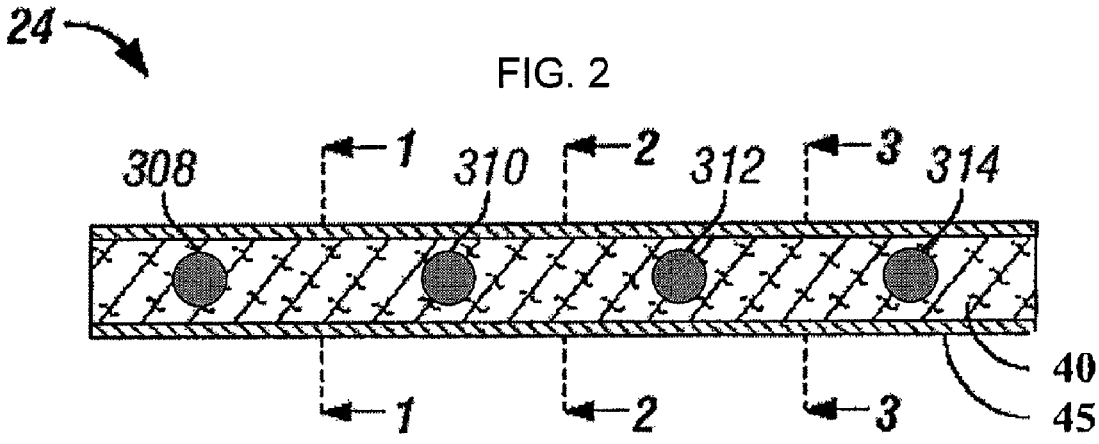
FIG. 2 is a cross-sectional view of a representative filter rod including filter material and interconnected objects positioned therein.

Referring to FIG. 2, a continuous filter rod 24 generally can be subdivided into cylindrical shaped filter elements or rod portions using techniques as are known by the skilled artisan familiar with conventional cigarette manufacturing. The filter rod 24 includes filter material 40 encased in circumscribing wrapping material 45 such as conventional air permeable or air impermeable paper plug wrap, or other suitable wrapping material. As an example, only one object, at least one object, or a plurality of objects 308, 310, 312 and 314 (shown spaced apart groups for clarity, but essentially adjacent to each other) may be disposed along the longitudinal axis of and within the rod 24. Where a plurality of objects is inserted into the rod 24, the objects may be disposed in a spaced apart relationship from one another, or immediately adjacent to each other so as to be, in some instances, serially engaged. In other instances (not shown), the objects are disposed so as to have a repeating pattern of objects or groups of objects (each group comprising one or more objects) separated by a space, wherein the space would correspond to a division between filter rod portions. One skilled in the art will note that the entire filter rod may include sufficient objects therein such that each filter rod portion includes the same number (i.e., one or more) objects when the filter rod is subdivided. For example, a four-up filter rod may include objects in multiples of four such that, upon subdivision, each filter rod portion may include 1, 2, 3, or 4 objects.

Figure 3:
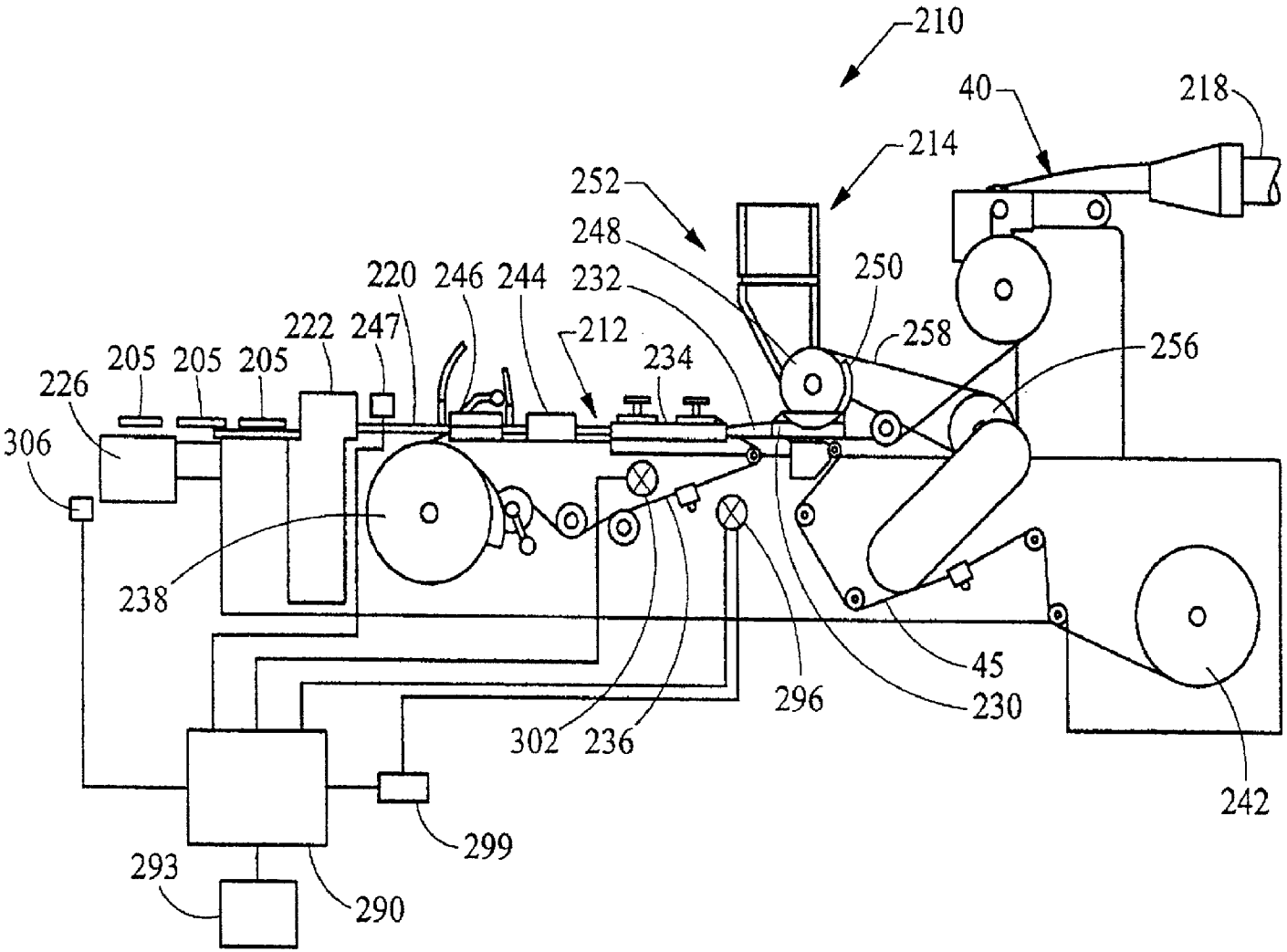
FIG. 3 is a schematic of a rod-making apparatus including a portion of the filter tow processing unit, a source of objects, an object insertion unit, a filter rod-forming unit and an inspection/detection system in accordance with one embodiment of the present invention.

FIG. 3 illustrates that such filter rods or rod portions 205, each incorporating at least one object, such as spherical, capsular, cylindrical (i.e., pellets), stranded, or other suitably shaped objects, can be manufactured using a rod-making apparatus 210. An exemplary rod-making apparatus 210 includes a rod-forming unit 212 (e.g., a KDF-2 unit available from Hauni-Werke Korber & Co. KG) and an object insertion unit 214 suitably adapted to provide for placement of the objects (not shown) within a continuous length of filter material 40. The continuous length or web of filter material is supplied from a source (not shown) such as a storage bale, bobbin, spool or the like. Generally, the filter material 40 is processed using a filter material processing unit 218. The continuous length of filter material having the objects incorporated therein is passed through the rod-forming unit 212 thereby forming a continuous rod 220, which can be subdivided using a rod cutting assembly 222 into a plurality of rod portions 205 each having at least one, and preferably a plurality, of the objects disposed therein. The succession or plurality of rod portions 205 are collected for use in collection device 226 which may be a tray, a rotary collection drum, conveying system, or the like. If desired, the rod portions can be transported directly to a cigarette making machine. In such a manner, in excess of 500 rod portions, each of about 100 mm length, can be manufactured per minute.

The filter material 40 can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. One highly preferred filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. Nos. 3,424,172 to Neurath; 4,811,745 to Cohen et al.; 4,925,602 to Hill et al.; 5,225,277 to Takegawa et al. and 5,271,419 to Arzonico et al.

Filamentary tow, such as cellulose acetate, is processed using a conventional filter tow processing unit 218 such as a commercially available E-60 supplied by Arjay Equipment Corp., Winston-Salem, N.C. Other types of commercially available tow processing equipment, as are known to those of ordinary skill in the art, may similarly be used. Normally a plasticizer such as triacetin is applied to the filamentary tow in traditional amounts using known techniques. Other suitable materials for construction of the filter element will be readily apparent to those skilled in the art of cigarette filter design and manufacture.

The continuous length of filter material 40 is pulled through a block 230 by the action of the rod-forming unit 212 and the objects are inserted along the length of and within the web of filter material. However, the objects may also be introduced into the filter material at other points in the process, and this exemplary embodiment is not intended to be limiting in that regard. The filter material is further directed into a gathering region 232 of the rod-forming unit 212. The gathering region can have a tongue and horn configuration, a gathering funnel configuration, stuffer or transport jet configuration, or other suitable type of gathering device. The tongue 232 provides for further gathering, compaction, conversion or formation of the cylindrical composite from block 230 into an essentially cylindrical (i.e., rod-like) shape whereby the continuously extending strands or filaments of the filter material extend essentially along the longitudinal axis of the cylinder so formed. In some instances, the objects may also be placed into the filter material in the gathering region 232, as appropriate.

The filter material 40, which has been compressed into a cylindrical composite, is received further into the rod-forming unit 212. The cylindrical composite is fed into wrapping mechanism 234, which includes endless garniture conveyer belt 236 or other garniture device. The garniture conveyer belt 236 is continuously and longitudinally advanced using advancing mechanism 238 such as a ribbon wheel or cooperating drum so as to transport the cylindrical composite through wrapping mechanism 234. The wrapping mechanism provides a strip of wrapping material 45 (e.g., non-porous paper plug wrap) to the outer surface of the cylindrical composite in order to produce continuous wrapped rod 220. In some instances, the objects may also be engaged with the filter material in the wrapping or garniture region 232, as appropriate. For example, the elongate member, as otherwise disclosed herein, may be in the form of a wrapping material 45 having the objects attached thereto or otherwise engaged therewith. In some instances, the elongate member may also include, for example, microcapsules (see, e.g., U.S. patent application Ser. No. 11/537,812 to Fagg, incorporated herein by reference) instead of or in addition to the objects, wherein the elongate member/wrapping material is wrapped about the filter material such that the objects/microcapsules are applied thereto.

Generally, the strip or web of wrapping material 45 is provided from rotatable bobbin 242. The wrapping material is drawn from the bobbin, is trained over a series of guide rollers, passes under block 230, and enters the wrapping mechanism 234 of the rod-forming unit. The endless garniture conveyer belt 236 transports both the strip of wrapping material and the cylindrical composite in a longitudinally extending manner through the wrapping mechanism 234 while draping or enveloping the wrapping material about the cylindrical composite.

The seam formed by an overlapping marginal portion of wrapping material has adhesive (e.g., hot melt adhesive) applied thereto at applicator region 244 in order that the wrapping material can form a tubular container for the filter material. Alternatively, the hot melt adhesive may be applied directly upstream of the wrapping material's entry into the garniture of the wrapping mechanism 234 or block 230, as the case may be. The adhesive can be cooled using chill bar 246 in order to cause rapid setting of the adhesive. It is understood that various other sealing devices and other types of adhesives can be employed in providing the continuous wrapped rod.

The continuous wrapped rod 220 passes from the sealing device and is subdivided (e.g., severed) at regular intervals at the desired, predetermined length using cutting assembly 222 which includes as a rotary cutter, a highly sharpened knife, or other suitable rod cutting or subdividing device. It is particularly desirable that the cutting assembly does not flatten or otherwise adversely affect the shape of the rod. The rate at which the cutting assembly severs the continuous rod at the desired points is controlled via an adjustable mechanical gear train (not shown), or other suitable device. The rate at which the objects are inserted into the continuous web of filter material is in a direct relationship to the speed of operation of the rod-making machine. The object insertion unit can be geared in a direct drive relationship to the drive assembly of the rod-making apparatus. Alternatively, the object insertion unit can have a direct drive motor synchronized with the drive assembly of the rod-forming unit. In some instances, the object insertion unit may be configured to be in communication with the inspection/detection system 247, for example, in the form of a feedback loop, whereby some defects detected by the inspection/detection system 247 may be eliminated by adjusting the upstream object insertion unit. In light of the relationship of the rate of object insertion and the rod-making machine, embodiments of the present invention are also directed to maintaining or increasing the production rate of the rod-making machine, without adversely affecting the object placement within the filter material.

The object insertion unit 214 may include a rotatable insertion member 248 having the shape of a wheel, which may be positioned so as to rotate in a vertical plane. The object insertion unit may also include a hopper assembly 252 and/or other transfer device for feeding or otherwise providing transfer of objects (such as, for example, capsules and/or pellets) to insertion member 248. As the insertion member rotates, individual objects (not shown) held within pocket (not shown) on the peripheral face of the wheel are brought into contact with the filter material 40 within the block 230, where the objects are ejected from the pockets into the gathered filter material 40. Details of such an object-insertion arrangement are further detailed, for example, in U.S. Pat. No. 7,115,085 to Deal; U.S. Patent Application Publication No. US 2007/0068540 A1 to Thomas et al.; U.S. patent application Ser. No. 11/461,941 to Nelson et al.; and U.S. patent application Ser. No. 11/760,983 to Stokes et al.

In controlling this process, a control system may include appropriate control hardware and/or software. An exemplary control system 290 can incorporate, for example, a Siemens 315-2DP Processor, a Siemens FM352-5 Boolean Processor and a 16 input bit/16 output bit module. Such a system can utilize a system display 293, such as a Siemens MP370 display. An exemplary rod-making unit 212 may include controls configured, for a rod of desired length, to adjust the speed of the knife of the severing unit to be timed relative to the speed of continuous rod formation. In such instances, a first encoder 296, by way of connection with the drive belt of the rod-making unit, and the control unit 299 of the insertion unit, may provide a reference of the knife position of the cutting assembly relative to the wheel position of the insertion unit. Thus, the first encoder 296 may provide one manner of controlling the speed of rotation of the wheel of the insertion unit relative to the speed at which continuous web of filter tow passes through the rod-making unit. An exemplary first encoder 296 is available as a Heidenhain Absolute 2048 encoder.

Figure 4:
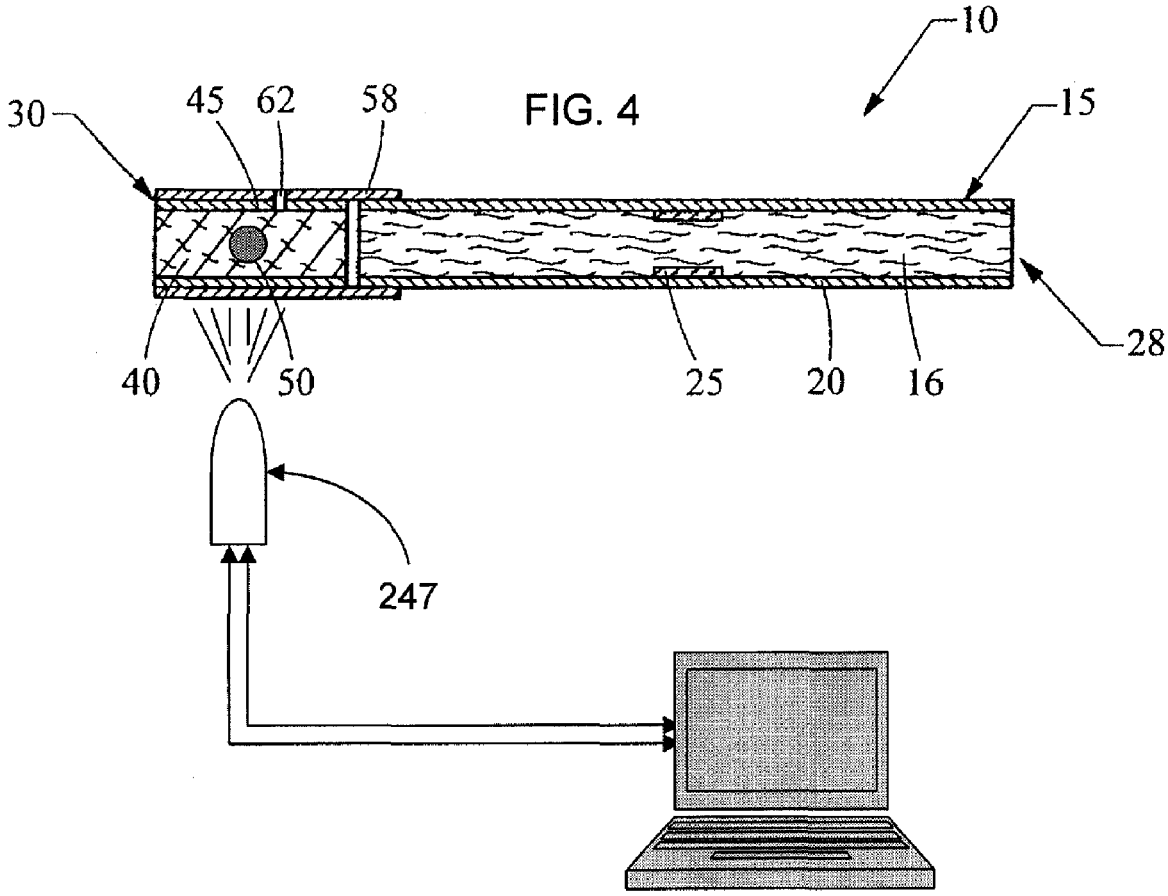
FIG. 4 is a schematic of a system for analyzing a filter element of at least one of a filter rod and a smoking article, according to one embodiment of the present invention.

The rod-making apparatus 210 can also include a system for providing information associated with rod production and operational analysis. For example, a rod-making apparatus 210, such as a commercially available KDF-2 type unit, can be adapted to include a processing or analysis unit such as, for example, a Siemens 314-C processor. The processing/analysis unit may include associated input and output modules. As such, the processing unit may be configured to monitor the operation of the rod-making apparatus 210 and to collect generated data. The collected data received by the processing unit can then be presented, for example, via an appropriate indicia such as on a video screen (See, e.g., FIG. 4), or otherwise transmitted or retrieved via a higher level operating system (e.g., via an Ethernet). For example, a remote data collection unit such as a Siemens IM-153 unit equipped with inputs, outputs and a counter module (available, for example, as a Siemens FM350-2 module), may be installed in a sending unit that receives the collected data from the processing unit via a bus system (e.g., Profibus). Depending upon the particular information gathered, data can be collected relating to, for instance, the number of rods manufactured during a particular time, the machine operating speed, the manufacturing efficiency of the rod-making apparatus, the number of interruptions in the manufacturing process, the number of filter elements provided to the rod-making unit, and any stoppage reasons.

Embodiments of the present invention may thus further include the inspection/detection system 247 for analyzing the filter rod or rod potion 205 to determine an object insertion status with respect to the inspection/detection of an object 50 therein, and to communicate this information to the processing/analysis unit. For example, such an object insertion status may include one or more of an object presence within the filter element, an object absence from the filter element, a proper insertion of an object into the filter element, a defective insertion of an object into the filter element, a proper object within the filter element, and a defective object within the filter element (i.e., object present, but not properly inserted (misaligned), or object present and properly inserted, but is otherwise defective (misshapen, leaking or ruptured)). Accordingly, such an inspection/detection system 247 may be beneficial for identifying defective filter rods or elements, or otherwise differentiating acceptable filter rods or elements from unacceptable (or defective) filter rods or elements, and making this information known through an appropriate indicia provided, for example, through a video screen via the processing/analysis unit (see, e.g., FIG. 4). In such instances, the smoking article manufacturing process can be improved, for instance, by removing the identified defective filter rods or elements from the production process. In such a manner, the efficiency of the manufacturing process may be improved (i.e., less rework or process rejects) while reducing or minimizing the number of smoking articles having defective filter elements reaching the consumer market. Such defects in the filter rods or elements may include missing objects, misplaced objects, misaligned objects, or, in the case of rupturable (breakable) elements, already ruptured objects. For example, a rupturable element, such as a capsule, may become ruptured or broken during or after insertion into the filter rod or element, while proceeding along the production process for the smoking article. Such a defect may be referred to as an already-broken-capsule ("ABC"). In other instances, the object or objects may be completely missing from the filter rod due to, for example, a malfunctioning insertion unit 214 used to insert objects into the filter rods or elements. Still in other instances, the objects may be misplaced, misaligned or mispositioned within the filter rod or element such that, during division of the filter rod into multiple filter elements, one or more of the objects may be severed by the cutting element of the cutting assembly, thereby causing a defect.

In some instances, the inspection/detection system 247 may be implemented in the rod-making apparatus 210 in an "on-line" manner along the production process, preferably after the one or more objects have been inserted into the filter rod and/or after the filter rod has been divided into individual filter elements. As such, the determination of the object insertion status of the filter rod or element may occur during the production process, without adversely affecting (or with reduced or minimal effect on) the throughput of the rod-making apparatus 210. Alternatively, the inspection/detection system 247 may be implemented in an "off-line" manner separate from the production process. In this manner, the filter rods or elements may be removed from or otherwise diverted from the production process for an "off-line" inspection before acceptable filter rods/elements are directed back to the smoking article production process. In any instance, the inspection/detection system 247 may be implemented at any point during the manufacturing process, following the insertion of the one or more objects into the filter rod or element. Accordingly, in some instances, the final smoking article (filter element plus tobacco rod) may be inspected, while in other instances, individual filter rods or elements may be inspected.

According to some aspects, the inspection/detection system 247 may be disposed in proximity to the cutting assembly 222 of rod-making apparatus 210, such as immediately before the cutting assembly 222, as illustrated in FIG. 1. In such instances, the continuous wrapped filter rod 220 proceeds along the rod-making apparatus 210 and is analyzed by the inspection/detection system 247 before being divided by the cutting assembly 222. The inspection/detection system 247 is further configured to determine the object insertion status of the filter rod/element (i.e., the continuous wrapped filter rod 220) and to direct the pertinent information to the control system 290 and/or the processing analysis unit for display of the object insertion status. Accordingly, any defective filter rods or elements (i.e., the object insertion status indicates one of an object absence from the filter element, a defective insertion of an object into the filter element, and a defective object within the filter element) may be identified and thus removed from the manufacturing process before the defect is realized in the smoking article end-product. In other instances, the inspection/detection system 247 may be disposed after the cutting assembly 222 such that individual filter elements are analyzed.

Figure 5:
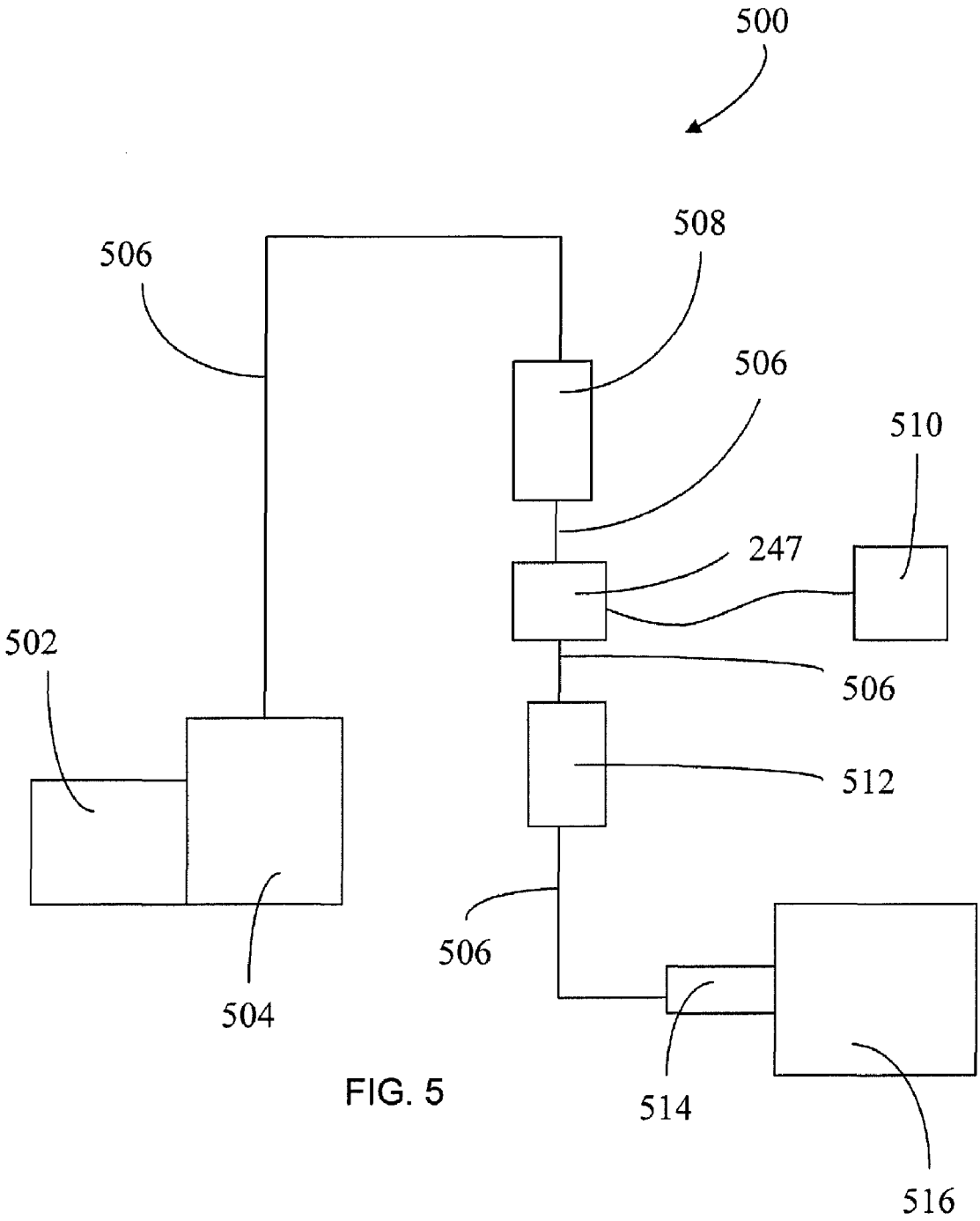
FIG. 5 is a schematic of an off-line inspection system according to one embodiment of the present invention.

As illustrated in FIG. 5, an exemplary embodiment of an off-line system 500 may be configured to receive filter rods from the manufacturing process via carrying trays (not shown) delivering the filter rods to a tray discharge unit 502 for automatically unloading the filter rods from the trays. A representative tray discharge unit 502 is available as a Magomat-SL tray discharger from Hauni Maschinenbau AG. The tray discharge unit 502 may be coupled to a distributor unit 504 for conveying the filter rods. That is, the distributor unit 504 may be configured to feed the filter rods pneumatically (known to those of skill in the art as "peashooting") to a predetermined destination. A representative distributor unit 504 is available, for example, as a Molins Pegasus-DX distributor unit. The filter rods are fed from the distributor unit 504 along a line 506, such as a peashooter line, to a velocity control device 508. In some instances, the peashooter line 506 may comprise small tubing having an internal diameter at least slightly larger than the diameter of the filter rod being transported therein. The filter rods may be pneumatically conveyed through the tubing toward the velocity control device 508, which decelerates the incoming filter rods from the peashooting line 506 and, by controlling the velocity of the filter rods, creates gaps between incoming filter rods. Moreover, the velocity control device 508 may also be configured to reduce the velocity of the incoming filter rods to a suitable velocity for analysis (i.e., controls the velocity so as to ensure accuracy and limit false signals) by the inspection/ detection system 247. A representative velocity control device is available as a Conac Unit from Molins PLC.

The inspection/detection system 247 may thus be disposed after the velocity control device 508, analyzing the filter rods directed thereby. In any instance, the inspection/detection system 247 may implement various sensor technologies for analyzing the filter rods to determine the object insertion status thereof, as otherwise described herein. A control/analysis unit 510 may be in communication with the inspection/detection system 247 for controlling the analysis parameters implemented thereby and for receiving output signals therefrom regarding the object insertion status of respective filter rods. Further, the inspection/detection system 247 may be configured to provide an output signal to a defective element removal device 512 in communication therewith such that any detected/identified defective filter rods (i.e., the object insertion status indicates one of an object absence from the filter element, a defective insertion of an object into the filter element, and a defective object within the filter element) are ejected or otherwise removed from the line 506. That is, the defective element removal device 512 is configured to reject filter rods based on the output signal indicative of a defective element received from the inspection/detection system 247. Filter rods not rejected by the defective element removal device 512 (i.e., "acceptable" filter rods) may be transported to a receiver unit 514 from the defective element removal 512 via the peashooter line 506. In one particular embodiment, the receiver unit 514 may redirect the direction of travel of the filter rods perpendicular to the axis thereof. A representative receiver unit is available as a Molins Pegasus-RX receiver unit. In some embodiments, the distributor unit 504 and the receiver unit 514 may comprise a single machine, such as, for example, the Pegasus-3000 Plug Distribution System from Molins PLC. After being received and redirected by the receiver unit 514, the inspected and acceptable filter rods may be automatically and subsequently loaded into trays by a tray filler device 516. In some instances, the tray filler device 516 may be directly coupled to the receiver unit 514 to receive filter rods from the peashooter line 506. A representative tray filler device is available as an HCF-ML tray filler from Hauni Maschinenbau AG. In some instances, the filled trays with "acceptable" filter rods may then be returned to the manufacturing process (i.e., put back "on-line").

In other embodiments, as mentioned previously, the filter rods may be subdivided into individual filter elements and attached to respective tobacco rods to form a smoking article end-product before being directed to the inspection/detection system 247 for inspection. In this manner, the end product, or completed smoking article, is analyzed by the inspection/detection system 247, in some instances in a final inspection procedure before packaging. Accordingly, any smoking articles having defective filter elements may be appropriately rejected and removed prior to distribution of the end product. To that end, the inspection/detection system 247 may be implemented in any manner during the filter rod and/or smoking article manufacturing process, provided that the analysis occurs downstream from the insertion of the object(s) into the filter rod or filter element. For example, the inspection/detection system 247 may be implemented in conjunction with the rod-forming unit 212, the distributor unit 504, the receiver unit 514, cigarette maker drums, packer vanes, a weight control system, with any other suitable components, or in conjunction with any combinations thereof.

Further, to facilitate and enhance overall product quality, multiple inspection/detection systems 247 and/or other multiple measurement schemes may be implemented as a redundancy measure. For example, both an on-line and off-line inspection/detection system 247 may be implemented in the manufacture of the filter rods and/or smoking articles in order to provide multiple analyses. That is, inspection/detection systems 247 may be applied during and/or after formation of filter rods, during and/or after formation of individual filter elements, and/or during and/or after formation of the cigarettes or other smoking articles, in on-line and/or off-line processes. In some instances, the inspection/detection system 247 may be coupled with an optical sensor, wherein the optical sensor is provided, for example, for monitoring the size of the filter rods.

In detecting objects within a filter rod/element and inspecting/analyzing such objects for defects and/or irregularities, many factors must be considered due to the varying characteristics of the possible defects. For instance, in the case of already-broken-capsules (ABC), the time elapsed between rupture of the rupturable element and inspection may limit the effectiveness of the inspection/detection system 247. To that end, various techniques and methods may be implemented within the inspection/detection system 247 to increase the effectiveness thereof. Accordingly, the inspection/detection system 247 may incorporate a sensor element/sensor head or other components for detecting and analyzing such defects. The sensor element may be connected (e.g., using appropriate wiring) to a programmable logic controller (PLC) (not shown). The PLC may be, in turn, connected to the control system of the rod-making unit 210. A representative PLC is available as KV-10R from Keyence Corporation. In other instances, the sensor element may be connected to a control unit remote from the control system of the rod-making unit 210 such that the inspection/detection system 247 is independently controlled.

In one such embodiment, the inspection/detection system 247 may incorporate a sensor element configured to measure density and/or moisture associated with the object, with respect to the material of the filter rod/element, for detecting/inspecting the object. In a further example, the density and/or moisture sensor element may further include a microwave radiation sensor component/sensor head and/or a beta radiation sensor component/sensor head, wherein such a sensor element may define a sensor window through which the filter rods or smoking articles may be analyzed by the selected sensor component. Such moisture and density sensors may be configured to measure density of the filter rod so as to determine whether an object is missing or misaligned within the filter rod. Thus, the sensor has the capacity to distinguish the density of the filter rod (i.e., cellulose acetate) from that of the object inserted therein. Accordingly, missing and rupturable elements that have been ruptured for a period of time (wherein the contents thereof have had an opportunity to disperse) will be detected due to a measured reduction in density. A representative beta radiation sensor component is available as TG-5 Beta Nucleonic Measurement sensor head from Automation and Control Technology, Inc. A representative microwave sensor component is available as MW-3010 from TEWS Elektronik. A control unit may be in communication with the sensor element such that the signal output therefrom relating to defective filter rods, received from the control unit, may allow the control unit to direct appropriate action to be taken, such as removing the defective filter rod from the manufacturing process. In some particular embodiments, the sensor element may be provided as a "horse-shoe" or "fork" type sensor element for facilitating analysis of the filter rods/elements or finished smoking articles.

Information and data can be collected, compiled, and stored by a suitable data collection and control unit. A representative data collection unit is available as DEWE2010 PC-Based Data Acquisition system from Dewetron, Inc.

In some instances, the filter rod may be defective in that a rupturable object disposed therein has ruptured at some point during or after insertion into the filter rod. To that end, after some elapsed time, the contents of the ruptured object will migrate to other portions of the filter rod. As such, the sensor element is capable of determining a change in density, and will appropriately relay an output signal of the determined defect to the control unit, as mentioned previously. However, a recently or near-recently ruptured object may not be detected by the sensor element since the contents of the ruptured object may not have yet diffused within the filter rod. As such that the density in or about the designated object position within the filter rod remains similar to that of a non-ruptured object. Accordingly, the sensor element may also be configured to detect moisture changes within the filter rods, as also previously noted. As such, when a rupturable object is ruptured, the moisture content of the filter rod measurably increases and such can be determined by the moisture-detecting sensor element. Accordingly, this information can be directed to the control unit for appropriate action.

In other embodiments, near-infrared technology may be used by the sensor element for analyzing the filter rods for defects. In some instances, such a sensor element may be particularly useful as implemented on a final inspection drum, such that the end product (smoking article) is analyzed thereby, since near-infrared technology can detect a unique signature from the objects inserted into the filter rods. An exemplary near-infrared (NIR) sensor and related controls are available as a solid state near infrared industrial gauge based on AOTF technology from Pettit Applied Technologies, Inc. In one example, in rupturable objects having menthol therein, near-infrared technology can detect the menthol within the filter rod, thereby permitting analysis thereof for defects (i.e., a non-ruptured object will have a contained volume of menthol, whereas a ruptured object will show a more diffuse presence of menthol through the filter element).

Still in other embodiments, an x-ray sensor may be implemented as the sensor element. In other instances, the sensor element may implement an ultrasonic sensor. In still other instances, the sensor element may be configured to measure capacitance as a mechanism for analyzing the object(s) with respect to the filter element. Yet in other embodiments, the sensor element may implement an infrared or other wavelength sensor, which, in some instances, may include certain light emitting diode (LED) technology. In other embodiments, a pressure variation sensor may be implemented as the sensor element for measuring changes in pressure so as to differentiate between proper (acceptable) and defective filter rods/elements. Still in other embodiments, thermal imaging, via a thermal sensor, may be implemented as the sensor element. In other instances, a Cadmium Zinc Telluride (CZT) crystalline technology sensor utilizing a synthetic reactive crystal may be implemented in conjunction with the inspection/detection system 247 as the sensor element. In yet other embodiments, an x-ray technology sensor implementing, for example, Z backscatter sensing may be incorporated within the inspection/detection system 247 as the sensor element.

Many modifications and other embodiments of the inventions set forth herein will come to mind to one skilled in the art to which these inventions pertain having the benefit of the teachings presented in the foregoing descriptions and the associated drawings. For example, a microwave detection unit (microwave radiation sensor component) and/or a beta radiation detector (beta radiation sensor component) may be used for automatic control of the filter element weight (i.e., by control or adjustment of the feed of the tow or other filter material to the rod-forming unit 212) and/or the application of an additive (i.e., a plasticizer). Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A system for analyzing a filter element of at least one of a filter rod and a smoking article, comprising:

at least one sensor element adapted to interact with the filter element comprising a filter material so as to determine an object insertion status with respect thereto and to generate an output signal in response, the object insertion status including one of an object presence within the filter element and an object absence from the filter element, and at least one of a proper insertion of an object into the filter element, a defective insertion of an object into the filter element, a proper object within the filter element, and a defective object within the filter element, wherein the at least one sensor element is configured to be capable of determining the object insertion status of an object comprising at least one of a pellet, a capsule, a strand, an exchange resin bead, and an absorbent particle, inserted into the filter material of the filter element; and an analysis unit in communication with the at least one sensor element and responsive to the output signal therefrom to generate an indicia corresponding to the object insertion status, wherein an object absence, a defective insertion, and a defective object each correspond to a defective filter element.

2. A system according to claim 1 wherein the at least one sensor element comprises at least one of a density sensor, a moisture sensor, a near-infrared sensor, an x-ray sensor, a capacitance sensor, an ultrasound sensor, a pressure sensor, a thermal sensor, a reactive crystal sensor, and a backscatter sensor.

3. A system according to claim 2 wherein the at least one sensor element comprises at least one of a beta radiation sensor component and a microwave radiation sensor component.

4. A system according to claim 1 further comprising a rod-making apparatus for making at least one of a filter rod and a smoking article, the rod-making apparatus including a filter element object insertion station for inserting an object into the filter material of the filter element, wherein the at least one sensor element is disposed downstream from the filter element object insertion station.

5. A system according to claim 1 further comprising a defective element removal device operably engaged with the analysis unit and responsive thereto to remove the defective filter element.

6. A system for analyzing a filter element of at least one of a filter rod and a smoking article, comprising:

sensor means adapted to interact with the filter element comprising a filter material so as to determine an object insertion status with respect thereto and to generate an output signal in response, the object insertion status including one of an object presence within the filter element and an object absence from the filter element, and at least one of a proper insertion of an object into the filter element, a defective insertion of an object into the filter element, a proper object within the filter element, and a defective object within the filter element, wherein the sensor means is configured to be capable of determining the object insertion status of an object comprising at least one of a pellet, a capsule, a strand, an exchange resin bead, and an absorbent particle, inserted into the filter material of the filter element;

analysis means in communication with the sensor means and responsive to the output signal therefrom to generate an indicia corresponding to the object insertion status, wherein an object absence, a defective insertion, and a defective object each correspond to a defective filter element.

7. A system according to claim 6 wherein the sensor means comprises at least one of a density sensor means, a moisture sensor means, a near-infrared sensor means, an x-ray sensor means, a capacitance sensor means, an ultrasound sensor means, a pressure sensor means, a thermal sensor means, a reactive crystal sensor means, and a backscatter sensor means.

8. A system according to claim 7 wherein the sensor means comprises at least one of a beta radiation sensor component means and a microwave radiation sensor component means.

9. A system according to claim 6 further comprising a rod-making means for making at least one of a filter rod and a smoking article, the rod-making means including a filter element object insertion means for inserting an object into the filter material of the filter element, wherein the sensor means is disposed downstream from the filter element object insertion means.

10. A system according to claim 6 further comprising a defective element removal means operably engaged with the analysis means and responsive thereto to remove the defective filter element.

11. A method of analyzing a filter element of at least one of a filter rod and a smoking article, comprising:

determining an object insertion status of the filter element comprising a filter material via at least one sensor element adapted to interact therewith, and generating an output signal in response, the object insertion status including one of an object presence within the filter element and an object absence from the filter element, and at least one of a proper insertion of an object into the filter element, a defective insertion of an object into the filter element, a proper object within the filter element, and a defective object within the filter element, wherein the at least one sensor element is configured to be capable of determining the object insertion status of an object comprising at least one of a pellet, a capsule, a strand, an exchange resin bead, and an absorbent particle, inserted into the filter material of the filter element;

generating an indicia corresponding to the object insertion status via an analysis unit in communication with the at least one sensor element and responsive to the output signal therefrom, wherein an object absence, a defective insertion, and a defective object each correspond to a defective filter element.

12. A method according to claim 11 wherein determining an object insertion status further comprises determining an object insertion status via at least one sensor element including at least one of a density sensor, a moisture sensor, a near-infrared sensor, an x-ray sensor, a capacitance sensor, an ultrasound sensor, a pressure sensor, a thermal sensor, a reactive crystal sensor, and a backscatter sensor.

13. A method according to claim 12 wherein determining an object insertion status via at least one sensor element further comprises determining an object insertion status via at least one sensor element including at least one of a beta radiation sensor component and a microwave radiation sensor component.

14. A method according to claim 11 further comprising inserting an object into the filter material of the filter element, at a filter element object insertion station of a rod-making apparatus, prior to determining the object insertion status of the filter element.

15. A method according to claim 11 further comprising removing the defective filter element, via a defective element removal device operably engaged with the analysis unit and responsive thereto.

* * * * *